US008137186B2

(12) United States Patent
Wright et al.

(10) Patent No.: US 8,137,186 B2
(45) Date of Patent: Mar. 20, 2012

(54) SECONDARY GAME SYSTEM, A GAMING SYSTEM AND A METHOD OF PROVIDING AT LEAST ONE SECONDARY GAME IN A GAMING SYSTEM

(75) Inventors: Dean Wright, Sydney (AU); Stephen Cowan, Sydney (AU)

(73) Assignee: Paltronics Australasia Pty Limited, Sydney (AU)

( * ) Notice: Subject to any disclaimer, the term of this patent is extended or adjusted under 35 U.S.C. 154(b) by 391 days.

(21) Appl. No.: 12/513,956

(22) PCT Filed: Oct. 31, 2007

(86) PCT No.: PCT/AU2007/001659

§ 371 (c)(1),
(2), (4) Date: Jun. 3, 2009

(87) PCT Pub. No.: WO2008/055291

PCT Pub. Date: May 15, 2008

(65) Prior Publication Data

US 2009/0233719 A1 Sep. 17, 2009

(30) Foreign Application Priority Data

Nov. 8, 2006 (AU) ..... 2006906239

(51) Int. Cl.
*G07F 17/34* (2006.01)

(52) U.S. Cl. ..... 463/20

(58) Field of Classification Search ..... 463/20
See application file for complete search history.

(56) References Cited

U.S. PATENT DOCUMENTS

| | | | |
|---|---|---|---|
| 7,144,321 | B2 | 12/2006 | Mayeroff |
| 7,452,269 | B2 | 11/2008 | Gauselmann |
| 2004/0009230 | A1 | 1/2004 | Richard et al. |
| 2004/0092302 | A1 | 5/2004 | Gauselmann |
| 2004/0198487 | A1 | 10/2004 | Schneider |
| 2005/0148383 | A1 | 7/2005 | Mayeroff |
| 2006/0025192 | A1 | 2/2006 | Walker et al. |
| 2006/0246980 | A1 | 11/2006 | Walker et al. |
| 2007/0087811 | A1 | 4/2007 | Mayeroff |
| 2008/0026831 | A1 | 1/2008 | Wright et al. |
| 2008/0113813 | A1 | 5/2008 | Wright et al. |
| 2008/0153563 | A1 | 6/2008 | Englman |

FOREIGN PATENT DOCUMENTS

| | | | |
|---|---|---|---|
| AU | 2004222841 | A1 | 11/2004 |
| EP | 1418552 | A2 | 5/2004 |
| WO | 2005107913 | A1 | 11/2005 |
| WO | 2006078670 | A2 | 7/2006 |
| WO | 2006096925 | A1 | 9/2006 |
| WO | 2006104731 | A2 | 10/2006 |

*Primary Examiner* — Fernando L Toledo
(74) *Attorney, Agent, or Firm* — Pearne & Gordon LLP

(57) ABSTRACT

A secondary game system for a gaming terminal network, including at least one secondary game controller for providing at least one secondary game; a communications device for receiving secondary game registration request messages and secondary game deregistration request messages from a gaming terminal; the system being responsive to a received secondary game registration request message from a gaining terminal by causing said gaming terminal to be registered in one of said at least one secondary game; the system being further responsive to a received secondary game deregistration request message from a gaming terminal by causing said gaming terminal to be deregistered from one of said at least one secondary game.

17 Claims, 5 Drawing Sheets

SECONDARY GAME SYSTEM, A GAMING SYSTEM AND A METHOD OF PROVIDING AT LEAST ONE SECONDARY GAME IN A GAMING SYSTEM

The present invention relates to a jackpot game system, a gaming system and a method of providing a plurality of jackpot games in a gaming system.

The invention has been developed primarily for use with a plurality of interlinked gaming machines in a gaming establishment and will be described with reference to this application. However, the invention is not limited to that particular field of use and is also suitable for use with online gaming, gaming machines that are distributed over a plurality of gaming establishments, lotto, pools, lotteries, art unions, bingo, raffles and other games involving one or more wagers being placed upon an outcome having a finite probability of occurring.

BACKGROUND

The discussion of the prior art within this specification is to assist the addressee to understand the invention and is not an admission of the extent of the common general knowledge in the field of the invention and is included without prejudice.

It is known to link gaming machines to provide a number of additional functionalities. This includes the ability to control the awarding of a prize, as the pool of available funds is greater and the amount of funds available is known rather than having to be estimated. Another known purpose of interlinking gaming machines is to provide secondary gaming such as a linked jackpot. In such a system, a central display typically provides the players with a visual indication of a presently available jackpot prize which is increased incrementally as the players operate the interlinked gaming machines. It is known by the players that the prize will be awarded when it reaches a secret, randomly selected value that is less than a predetermined limit value. The limit value is often also visually indicated to the players by means of the display.

The use of such functionality is intended to attract players to play the machines in the hope of winning the jackpot. However, with the increased sophistication of players and their increased exposure to such systems, the systems' ability to maintain players' interest has diminished.

It is an object of the present invention to overcome, or at least substantially ameliorate, one or more of the disadvantages of the prior art or at least to provide a useful alternative.

SUMMARY OF THE INVENTION

A first aspect of the invention provides a jackpot game system for a gaming terminal network, including:

at least one jackpot game controller for providing a plurality of jackpot games; and a communications device for receiving jackpot game registration request messages and jackpot game deregistration request messages from a gaming terminal, said jackpot game registration request messages being sent in response to operation of a user-operable registration input device for allowing a user of the gaming terminal to indicate a desire to register in at least one of said plurality of jackpot games;

the system being responsive to a received jackpot game registration request message from the gaming terminal by causing said gaming terminal to be registered in at least one of said plurality of jackpot games such that a proportion of gaming activity on a primary game of the gaming terminal is contributed to the registered at least one jackpot game; and the system being further responsive to a received jackpot game deregistration request message from the gaming terminal by causing said gaming terminal to be deregistered from one of said plurality of jackpot games such that substantially none of the gaming activity of the primary game is contributed to the at least one unregistered jackpot game.

The jackpot game system preferably includes a plurality of jackpot game controllers for providing respective jackpot games.

The jackpot game system is preferably responsive to a received jackpot game registration request message from a gaming terminal by causing said gaming terminal to be registered in one of said jackpot games selected in dependence upon data extracted from said jackpot game registration request message. Additionally or alternatively, the jackpot game system is preferably responsive to a received jackpot game deregistration request message from a gaming terminal by causing said gaming terminal to be deregistered from one of said jackpot games determined in dependence upon data extracted from said jackpot game deregistration request message. Preferably, the jackpot game controllers include respective jackpot game controller communications devices for receiving messages from respective pluralities of gaming terminals.

Each of the jackpot game controllers is preferably adapted upon receipt of a jackpot game registration request message or a jackpot game deregistration request message to communicate with another of the jackpot game controllers in dependence upon data extracted from said jackpot game registration request message or jackpot game deregistration request message.

The jackpot game controller communications devices are preferably adapted to receive jackpot game contribution messages, and wherein the jackpot game controllers are adapted upon receipt of a jackpot game contribution message to communicate with another of the jackpot game controllers. The jackpot game system preferably further includes a jackpot game coordinator in communication with said plurality of jackpot game controllers, and adapted to maintain a database including for each of a plurality of gaming terminals data indicative of respective jackpot games in which the gaming terminal is registered.

A second aspect of the invention provides a gaming system including a gaming terminal and a jackpot game system as set out above.

The gaming terminal is preferably configured so as to display information regarding available jackpot games.

Additionally or alternatively, the gaming terminal preferably includes a user-operable deregistration input device for allowing a user of the gaming terminal to indicate a desire to deregister from a jackpot game, and wherein the gaming terminal is responsive to operation of the user-operable deregistration input device by sending a jackpot game deregistration request message to the jackpot game system.

The gaming terminal preferably includes a user-operable jackpot game contribution input device for allowing a user of the gaming terminal to specify a desired contribution to a jackpot game.

A further aspect of the invention provides a method of providing a plurality of jackpot games in a gaming terminal network, including: receiving jackpot game registration request messages and jackpot game deregistration request messages from a gaming terminal, said jackpot game registration request messages being sent in response to operation of a user-operable registration input device for allowing a user of the gaming terminal to indicate a desire to register in at least one of said plurality of jackpot games; responding to a received jackpot game registration request message from the gaming terminal by causing said gaming terminal to be registered in at least one of said plurality of jackpot games such that a proportion of gaming activity on a primary game of the gaming terminal is contributed to the registered at least one jackpot game; and responding to a received jackpot game deregistration request message from the gaming terminal by causing said gaming terminal to be deregistered from at least one of said plurality of jackpot games such that substantially none of the gaming activity of the primary game is contributed to the at least one unregistered jackpot game.

Preferably, the step of responding to a received jackpot game registration request message from a gaming terminal includes the steps of: extracting data from said jackpot game registration request message; and causing said gaming terminal to be registered in one of said jackpot games selected in dependence upon said extracted data.

The step of responding to a received jackpot game deregistration request message from a gaming terminal preferably includes the steps of: extracting data from said jackpot game deregistration request message; and causing said gaming terminal to be deregistered from one of said jackpot games determined in dependence upon said extracted data.

The method preferably includes the step of: maintaining a database including for each of a plurality of gaming terminals data indicative of respective jackpot games in which the gaming terminal is registered.

Other aspects of the invention provide a computer program for causing a computer to execute a method as set out above, a data carrier carrying data embodying such a computer program and a signal carrying data embodying such a computer program.

BRIEF DESCRIPTION OF THE DRAWINGS

Preferred embodiments of the invention will now be described, by way of example only, with reference to the accompanying drawings, in which.

DETAILED DESCRIPTION

Figure 1:
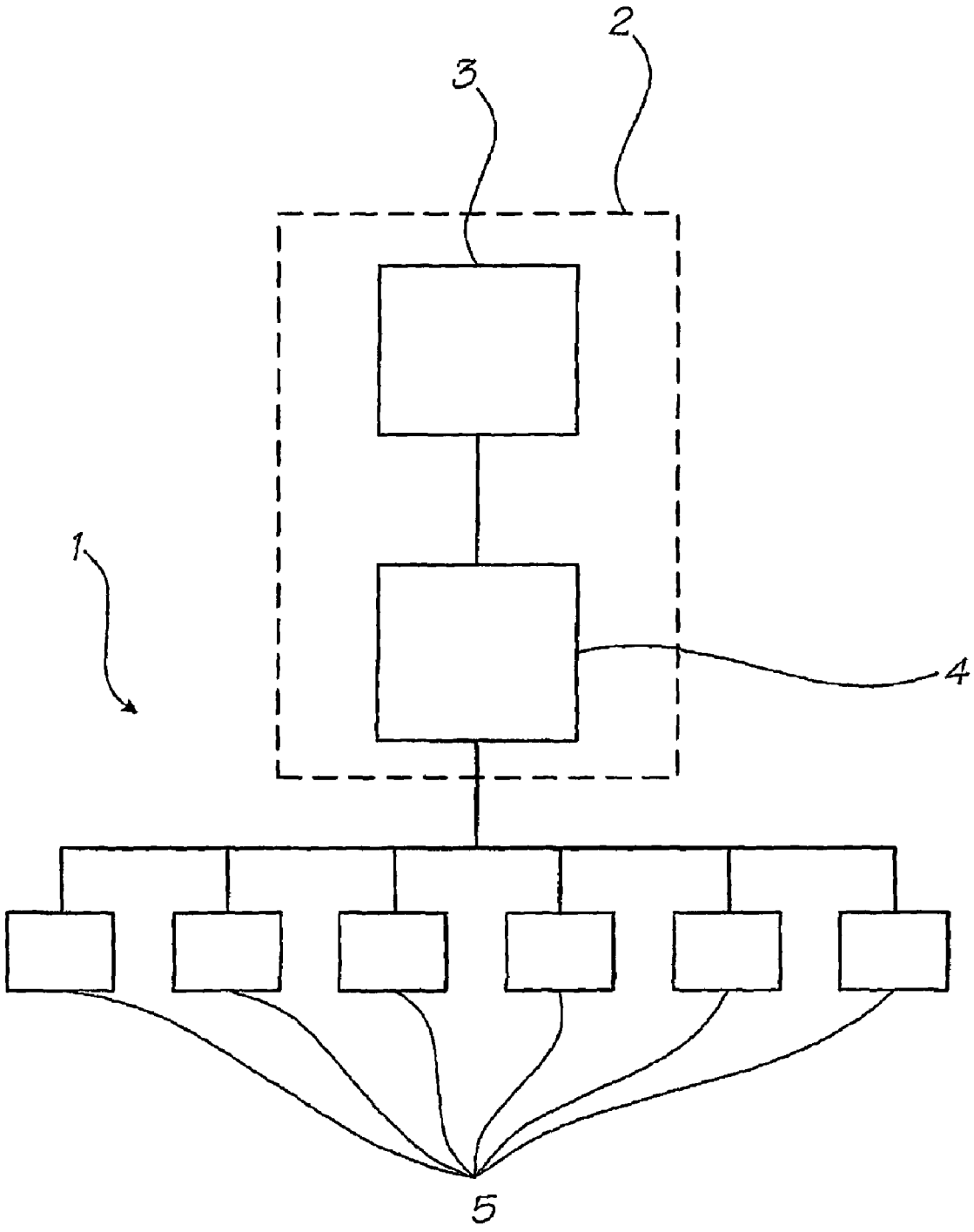
FIG. 1 is a schematic block diagram of a gaming system including a jackpot game system.

In overview, FIG. 1 is a schematic block diagram of a gaming system 1 including a jackpot game system 2 for a gaming terminal network. The jackpot game system includes at least one jackpot game controller 3 for providing a plurality of jackpot games, and a communications device 4 for receiving jackpot game registration request messages and jackpot game deregistration request messages from a gaming terminal 5. The jackpot game system 2 is responsive to a received jackpot game registration request message from a gaming terminal 5 by causing said gaming terminal to be registered in at least one of said jackpot games. The jackpot game system 2 is further responsive to a received jackpot game deregistration request message from a gaming terminal 5 by causing said gaming terminal to be deregistered from at least one of said jackpot games.

Figure 2:
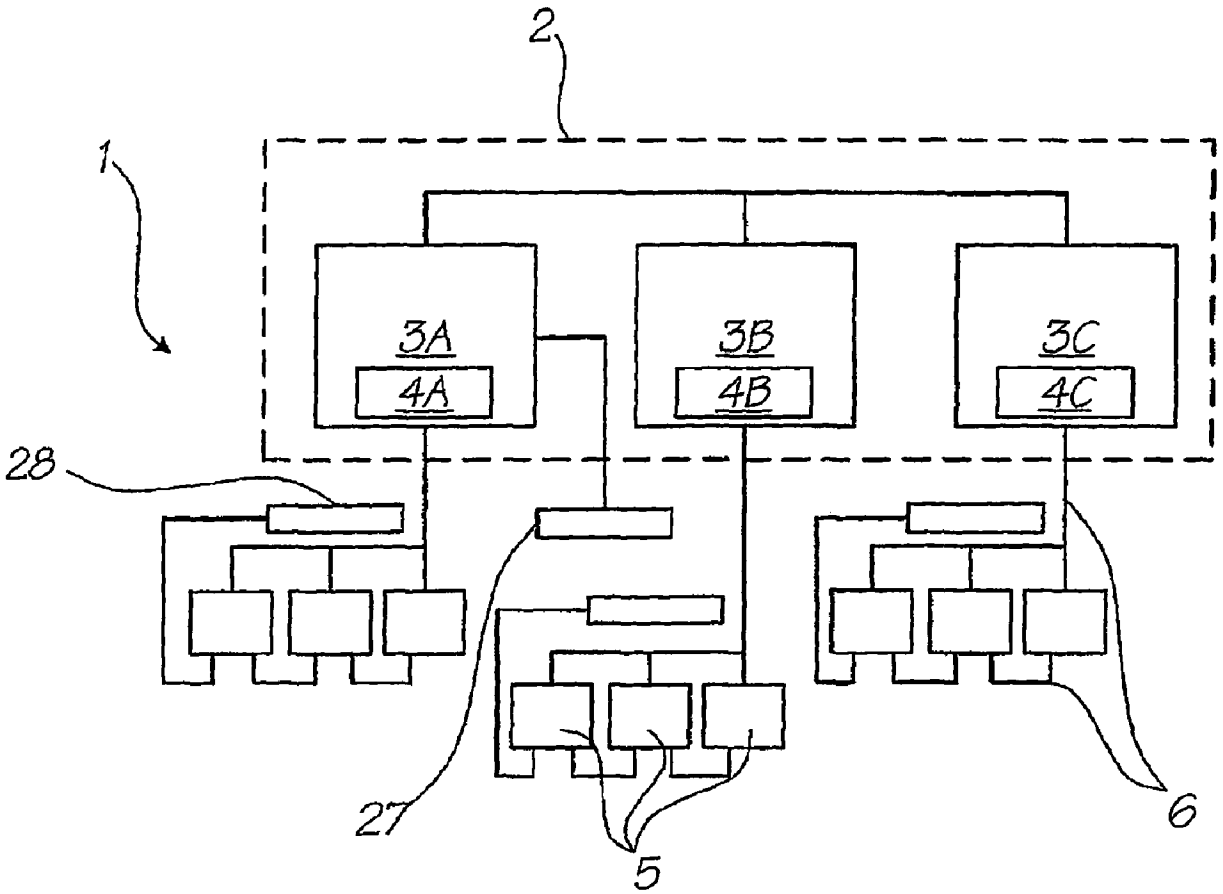
FIG. 2 is a schematic block diagram of a preferred embodiment of a gaming system.

FIG. 2 shows a preferred structure of a gaming system 1. This gaming system includes a jackpot game system 2, which in turn includes three jackpot game controllers or jackpot controllers 3A, 3B, 3C for providing respective secondary games in the form of jackpot games. In this specification, "jackpot game" is intended to mean a single- or multi-level jackpot game in which a player participates by playing a primary game on a gaming terminal, a proportion of the gaming activity of the primary game being used as a contribution in the jackpot game. In this context, some non-limiting examples of "gaming activity" include wagers made on, or the turnover of, or the funds added to, the gaming terminal. Each of the jackpot game controllers provides a particular respective jackpot game, and each includes a respective communications device 4A, 4B, 4C for communicating with a respective cluster of gaming terminals 5 via a serial, non-addressable, multi-drop communications link, such as an RS-485 link 6. In one embodiment, by default, each of the gaming terminals 5 connected to a particular jackpot game controller 3 A, 3B, 3 C is registered in the jackpot game provided by that controller (the "local" jackpot game). In another embodiment, the gaming system is initialised such that each of the gaming terminals is registered in a jackpot game selected by venue management.

Figure 3:
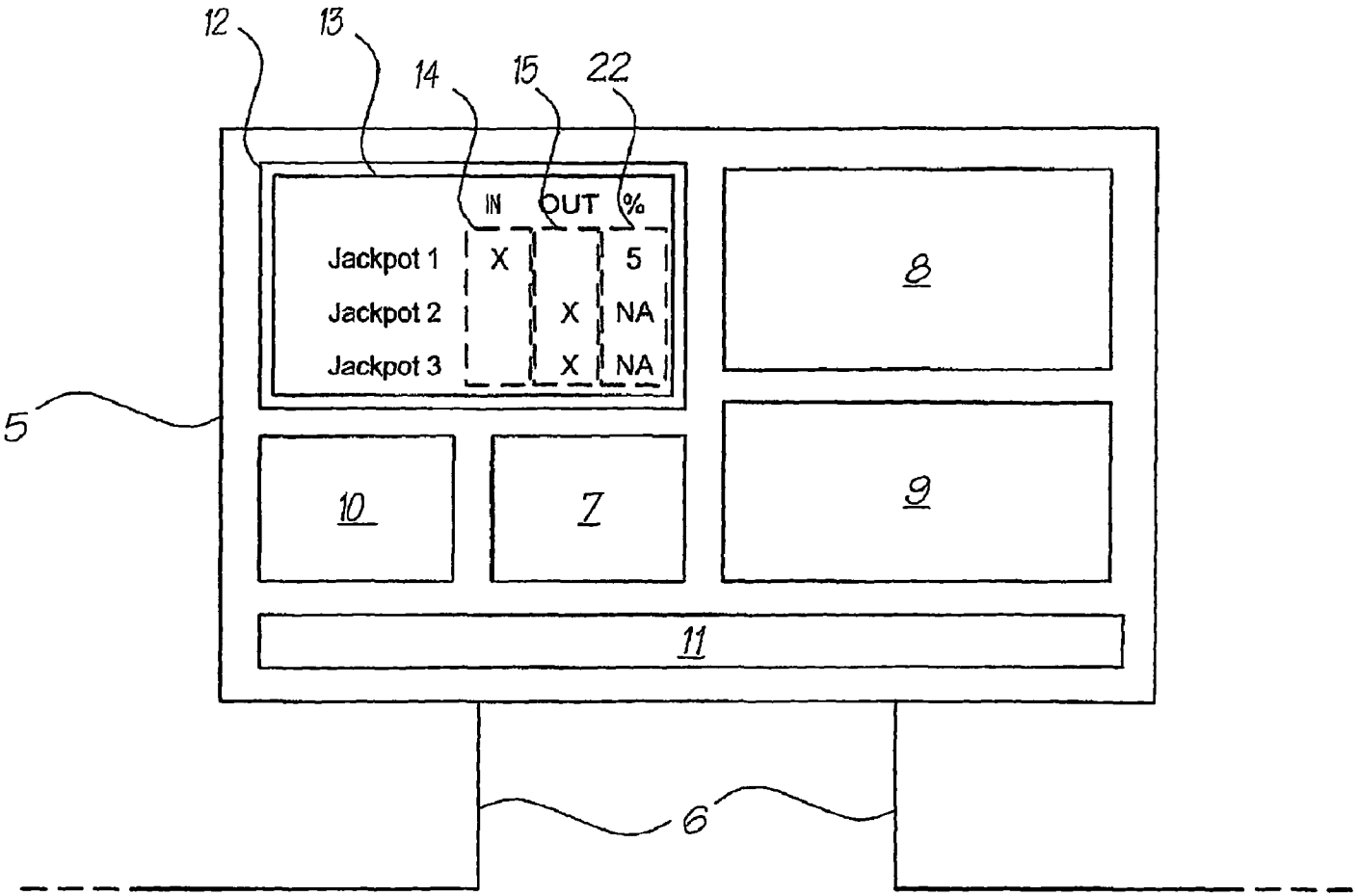
FIG. 3 is a more detailed schematic block diagram of a gaming terminal of the gaming system shown in FIG. 2.

With reference to FIG. 3, each gaming terminal 5 includes a processor 7 for providing a primary game. A display screen 8 provides a user with information regarding the primary game, and a control panel 9 allows the user to make selections and input information relating to the primary game. Memory 10 is also provided. A communications card 11 allows communication with the jackpot game system 2. A jackpot game control panel 12 is also provided having a touch screen 13 for displaying information regarding available jackpot games and for allowing the user of the gaming terminal to make selections. A first region 14 of the touch screen 13 serves as a user-operable registration input device, in that the user of the gaming terminal may operate that region 14 to indicate a desire to register in a jackpot game. Similarly, a second region 15 of the touch screen 13 serves as a user-operable deregistration input device, in that the user may operate that region 15 to indicate a desire to deregister from a jackpot game.

The gaming terminal is responsive to operation of the first region 14 of the touch screen by sending a jackpot game registration request message to the jackpot game system 2. The jackpot game registration request message includes information identifying: the gaming terminal sending the message; and the jackpot game to which registration is desired. Similarly, the gaming terminal is responsive to operation of the second region 15 of the touch screen by sending a jackpot game deregistration request message to the jackpot game system 2. The jackpot game deregistration request message includes information identifying: the gaming terminal sending the message; and the jackpot game from which deregistration is desired.

In one embodiment, a gaming terminal may only be registered in one jackpot game at any time. In this embodiment, when the first region 14 of the touch screen 13 is operated, the gaming terminal 5 sends both a jackpot game registration request message to effect registration in the newly selected jackpot game, and a jackpot game deregistration request message to effect deregistration from the previous jackpot game. In an alternative such embodiment, a single message is sent which effects both transactions. In other embodiments, registration in zero or multiple jackpot games is permitted; in such embodiments, it is not necessary to effect both types of transaction at each operation of the first and second regions 14, 15 of the touch screen 13.

In one embodiment, the gaming terminal sends jackpot game contribution messages in a known way to the jackpot game controller 3A, 3B, 3C. In other embodiments, for example in which registration in more than one jackpot game is permitted, more sophisticated jackpot game contribution messages are required which include both information to identify the value of the contribution, and addressing information of the controller 3 A, 3B, 3 C providing the jackpot game to which the contribution is to be made.

Figure 4:
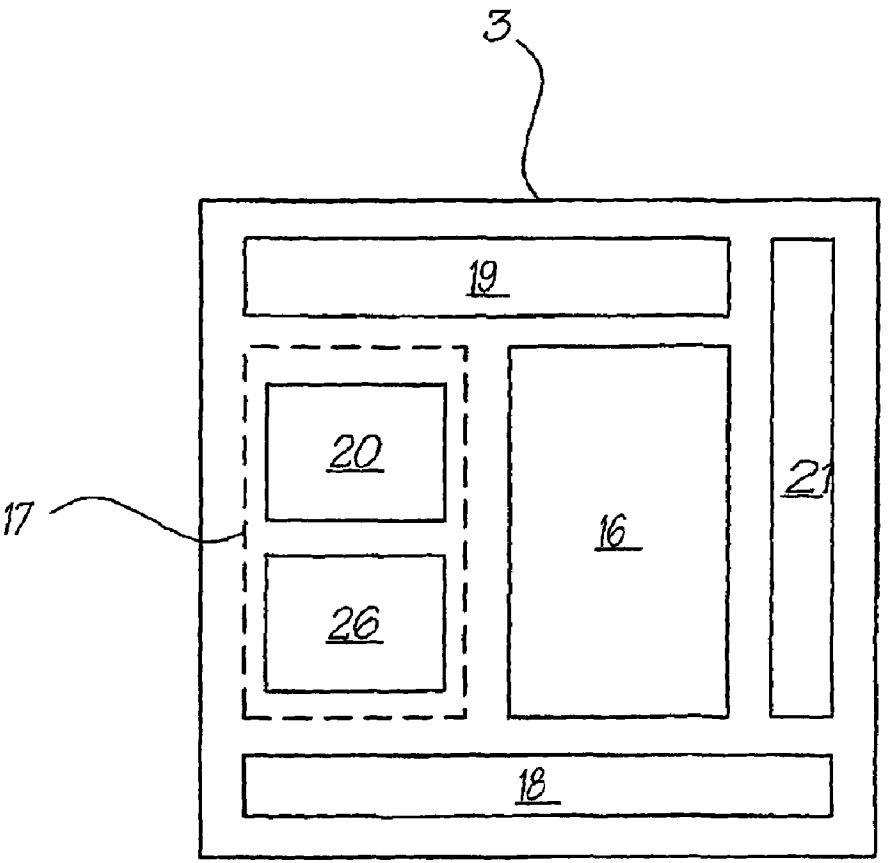
FIG. 4 is a more detailed schematic block diagram of a jackpot game controller of the gaming system shown in FIG. 2.

FIG. 4 is a block diagram of a jackpot game controller 3 forming part of the jackpot game system 2. The jackpot game controller 3 includes a processor 16, for providing a jackpot game, and associated memory 17. The controller 3 also includes a communications device 18, in the form of an RS-485 card, for communications with gaming terminals 5. A second communications device 19, in the form of an interface card for an addressable communications network such as an Ethernet, provides for communication between jackpot game controllers 3 in the jackpot game system 2. In the memory 17, the controller 3 stores information 20 regarding the associated gaming terminals 5. That is to say, for each gaming terminal 5 connected to the controller via the RS-485 link, the memory includes information regarding the jackpot game or games in which each associated gaming terminal is registered. The jackpot game controller also includes a video card 21 for controlling a display screen 22 for displaying to users of gaming terminals 5 information regarding the jackpot game being provided by the jackpot game controller. Upon receipt of a jackpot game registration request message from a gaming terminal 5, a jackpot game controller 3A extracts from the message the information identifying the gaming terminal and the desired jackpot game. If the desired jackpot game is the local jackpot game, the jackpot game controller 3A updates the stored information to indicate that the gaming terminal is registered in that jackpot game. If the desired jackpot game is a jackpot game provided by another jackpot game controller 3B, 3C (a "remote" jackpot game), the jackpot game controller receiving the message updates the stored information to indicate the controller 3B, 3C to which jackpot game contribution messages from that gaming terminal 5 are to be passed. The jackpot game controller 3A also sends a jackpot game registration control message to the jackpot game controller 3B, 3C providing the desired jackpot game. That jackpot game controller 3B, 3C updates information stored in its memory to indicate that a remote gaming terminal is registered.

In an analogous way, upon receipt of a jackpot game deregistration message from a gaming terminal 5, the jackpot game controller 3A extracts from the message the information identifying the gaming terminal and the jackpot game from which deregistration is desired. Locally stored information about the gaming terminal 5 is updated and a message sent to a further jackpot game controller 3B, 3C, if the identified jackpot game is remote.

As indicated above, the gaming terminals 5 send jackpot game contribution messages. The jackpot game controllers 3A, 3B, 3C extract from these messages information identifying the gaming terminal 5 from which they were sent. By accessing the locally stored information 20, a controller 3A receiving such a message is able to determine whether the contribution is to be applied to the local jackpot game, or if the message must be forwarded to another of the jackpot game controllers 3B, 3C.

In a preferred embodiment, the gaming terminals 5 include respective user-operable jackpot game contribution input devices, in the form of a third region 22 of the touch screen 13, for allowing a user of the gaming terminal to specify a desired contribution to a jackpot game. A similar system is discussed in our copending PCT patent application published with the number WO 2005/107913 A1, the full contents of which are herein incorporated by reference. In this way, the user may reduce or increase the amount of his contribution to a jackpot game, and thereby reduce or increase the likelihood of winning the jackpot game, while simultaneously increasing or reducing his wager on the primary game.

Figure 5:
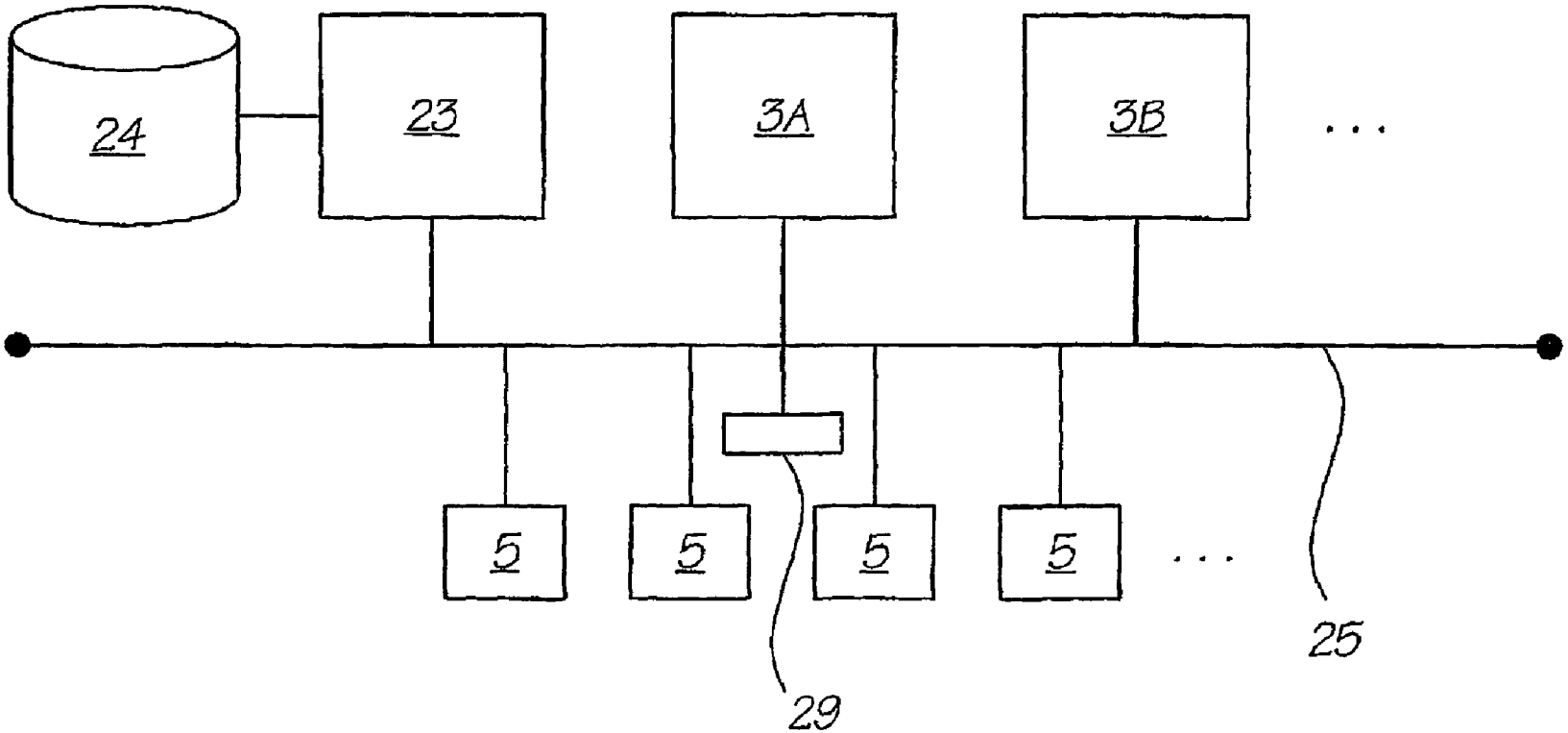
FIG. 5 is a schematic block diagram of another embodiment of a gaming system.

In the foregoing example, data indicating which gaming terminal 5 is registered in which of the jackpot games is stored and processed by the jackpot game controllers 3A, 3B, 3C themselves. In a further embodiment, shown schematically in FIG. 5, a jackpot game coordinator 23 is provided in communication with the jackpot game controllers. In this embodiment, the jackpot game coordinator 23 maintains a database 24 including for each of a plurality of gaming terminals data indicative of respective jackpot games in which the gaming terminal is registered. The gaming terminals, the jackpot game controllers and the jackpot game coordinator communicate via an Ethernet link 25, and the jackpot game coordinator ensures that jackpot game contribution messages are routed to the appropriate jackpot game controller 3A, 3B, 3C.

In the previously described embodiment of a gaming system, shown in FIG. 2, the routing of messages from the gaming terminals to the appropriate jackpot game controller is managed by the jackpot game controllers. In the present embodiment, shown in FIG. 5, using an Ethernet or another addressable networking system, the gaming terminals themselves, or the respective communication cards 11 in the gaming terminals, may include addressing information in the various messages that they send. Alternatively, all messages sent by the gaming terminals may be received by the jackpot game coordinator, which responds by issuing appropriately addressed messages to the appropriate jackpot game controllers.

In a preferred embodiment, at least one of the jackpot games (a "restricted" jackpot game) is only available to users of gaming terminals 5 that are providing a specified primary game. In such an embodiment, the jackpot game system stores resource data 26, for example in the memory of the jackpot game controllers 3A, 3B, 3C. This resource data includes executable files and audiovisual data for allowing the gaming terminals to provide a particular primary game. In the event that a user indicates a desire to participate in a restricted jackpot game, and his gaming terminal is not already providing the necessary primary game, the gaming terminal downloads the resource data 26 from the jackpot game system 2. This functionality is discussed in further detail in our copending PCT patent application published with the number WO 2006/096925 A 1, the full contents of which are herein incorporated by reference. In any of the previously described embodiments, screens may display information regarding the available jackpot games, to enable users of the gaming terminals to make informed decisions as to which jackpot game they wish to participate in. This information may include any or all of: the name of the jackpot game, the presently accrued value of a jackpot, the maximum and minimum values of the jackpot, the number of gaming terminals presently registered in the jackpot game, the primary games to which the jackpot game is restricted (if any), and so on.

In some embodiments, screens 27 (in FIG. 2) are controlled by the jackpot game controllers via a video card 21 (shown in FIG. 4). Additionally or alternatively, the information may be shown on screens 28 (in FIG. 2) connected to the jackpot controllers via the same communications path as the gaming terminals. Additionally or alternatively, the display screen 8 or the touch screen 13 of the gaming terminals may display this information. Finally, the jackpot game coordinator 23 may drive one or more displays for providing this information to users of the gaming terminals, or dedicated display units 29 may be connected to the Ethernet network (shown in FIG. 5). Thus, any or all of the above information may be communicated around the gaming network and stored in memory in various locations, including: memory 10 of the gaming terminals 5, memory in the communications card 11 of the gaming terminals, memory 17 of the jackpot game controllers 3, and memory in—or the database 24 maintained by—the jackpot game coordinator 23.

In some embodiments of the invention, the gaming terminals are provided in a single venue. In alternative embodiments, the gaming terminals are distributed among a number of such establishments or other locations and/or the terminals include other devices such as personal computers. In some such latter cases, communication between the terminals and the jackpot game system may be effected for example by means of an existing network, such as the internet, or by telephone dial-up or radio communication or by a combination of the above.

Although the invention has been described with reference to specific examples, it will be appreciated by those skilled in the art that it may be embodied in many other forms. In particular features of any one of the various described examples may be provided in any combination in any of the other described examples.

The claims defining the invention are as follows:

1. A jackpot game system for a gaming terminal network, including:

at least one jackpot game controller for providing a plurality of jackpot games; and a communications device for receiving jackpot game registration request messages and jackpot game deregistration request messages from a gaming terminal, said jackpot game registration request messages being sent in response to operation of a user-operable registration input device for allowing a user of the gaming terminal to indicate a desire to register in at least one of said plurality of jackpot games;

the system being responsive to a received jackpot game registration request message from the gaming terminal by causing said gaming terminal to be registered in at least one of said plurality of jackpot games such that a proportion of gaming activity on a primary game of the gaming terminal is contributed to the registered at least one jackpot game; and the system being further responsive to a received jackpot game deregistration request message from the gaming terminal by causing said gaming terminal to be deregistered from one of said plurality of jackpot games such that substantially none of the gaming activity of the primary game is contributed to the at least one unregistered jackpot game.

2. A jackpot game system according to claim 1 including a plurality of jackpot game controllers for providing respective jackpot games.

3. A jackpot game system according to claim 2, being responsive to a received jackpot game registration request message from a gaming terminal by causing said gaming terminal to be registered in one of said jackpot games selected in dependence upon data extracted from said jackpot game registration request message.

4. A jackpot game system according to claim 2, being responsive to a received jackpot game deregistration request message from a gaming terminal by causing said gaming terminal to be deregistered from one of said jackpot games determined in dependence upon data extracted from said jackpot game deregistration request message.

5. A jackpot game system according to claim 2, wherein the jackpot game controllers include respective jackpot game controller communications devices for receiving messages from respective pluralities of gaming terminals.

6. A jackpot game system according to claim 5, wherein each of the jackpot game controllers is adapted upon receipt of a jackpot game registration request message or a jackpot game deregistration request message to communicate with another of the jackpot game controllers in dependence upon data extracted from said jackpot game registration request message or jackpot game deregistration request message.

7. A jackpot game system according to claim 5, wherein the jackpot game controller communications devices are adapted to receive jackpot game contribution messages, and wherein the jackpot game controllers are adapted upon receipt of a jackpot game contribution message to communicate with another of the jackpot game controllers.

8. A jackpot game system according to claim 2, including a jackpot game coordinator in communication with said plurality of jackpot game controllers, and adapted to maintain a database including for each of a plurality of gaming terminals data indicative of respective jackpot games in which the gaming terminal is registered.

9. A gaming system including a gaming terminal and a jackpot game system according to claim 1.

10. A gaming system according to claim 9, wherein the gaming terminal is configured so as to display information regarding available jackpot games.

11. A gaming system according to claim 9, wherein the gaming terminal includes a user-operable deregistration input device for allowing a user of the gaming terminal to indicate a desire to deregister from a jackpot game, and wherein the gaming terminal is responsive to operation of the user-operable deregistration input device by sending a jackpot game deregistration request message to the jackpot game system.

12. A gaming system according to claim 9, wherein the gaming terminal includes a user-operable jackpot game contribution input device for allowing a user of the gaming terminal to specify a desired contribution to a jackpot game.

13. A method of providing a plurality of jackpot games in a gaming terminal network, including: receiving jackpot game registration request messages and jackpot game deregistration request messages from a gaming terminal, said jackpot game registration request messages being sent in response to operation of a user-operable registration input device for allowing a user of the gaming terminal to indicate a desire to register in at least one of said plurality of jackpot games; responding to a received jackpot game registration request message from the gaming terminal by causing said gaming terminal to be registered in at least one of said plurality of jackpot games such that a proportion of gaming activity on a primary game of the gaming terminal is contributed to the registered at least one jackpot game; and responding to a received jackpot game deregistration request message from the gaming terminal by causing said gaming terminal to be deregistered from at least one of said plurality of jackpot games such that substantially none of the gaming activity of the primary game is contributed to the at least one unregistered jackpot game.

14. A method according to claim 13, including the step of:

maintaining a database including for each of a plurality of gaming terminals data indicative of respective jackpot games in which the gaming terminal is registered.

15. A method according to claim 13 wherein the steps are executed using a computer program.

16. A method according to claim 15 wherein the computer program is embodied in data carried on a data carrier.

17. A method according to claim 15 wherein the computer program is embodied in data carried in a signal.

* * * * *